United States Patent [19]

Rose

[11] Patent Number: 4,481,386

[45] Date of Patent: Nov. 6, 1984

[54] MULTISTAGE ROTARY SWITCH

[75] Inventor: Jochen Rose, Röthenbach, Fed. Rep. of Germany

[73] Assignee: International Standard Electric Corporation, New York, N.Y.

[21] Appl. No.: 434,953

[22] Filed: Oct. 18, 1982

[30] Foreign Application Priority Data

Oct. 28, 1981 [DE] Fed. Rep. of Germany ..... 3142691

[51] Int. Cl.[3] ..... H01H 19/04

[52] U.S. Cl. ..... 200/11 R; 200/11 D; 200/307

[58] Field of Search ..... 200/11 R, 11 A, 11 B, 200/11 C, 11 D, 11 DA, 11 E, 11 EA, 11 G, 11 H, 11 J, 11 K, 11 TC, 11 TW; 200/164 R, 307, 14, 18

[56] References Cited

U.S. PATENT DOCUMENTS

| | | | |
|---|---|---|---|
| 3,258,547 | 6/1966 | Rector | 200/11 A |
| 3,499,133 | 3/1970 | Tillack et al. | 200/11 A |
| 3,736,390 | 5/1973 | Lockard | 200/11 DA |
| 3,883,706 | 5/1975 | Glaser | 200/11 A |

*Primary Examiner*—A. D. Pellinen
*Assistant Examiner*—Morris Ginsburg
*Attorney, Agent, or Firm*—James B. Raden; William J. Michals

[57] ABSTRACT

A multistage rotary switch with several wafers, is provided with one case member with fixed contacts per switch wafer and one rotor with the movable contacts. The rotor is axially acted upon by the contact springs. The edges of the case members adjoining one another, are provided with centering grooves of the same type, in which a centering ring is inserted, and the centering ring and rotor are made from a low-friction plastic material.

11 Claims, 1 Drawing Figure

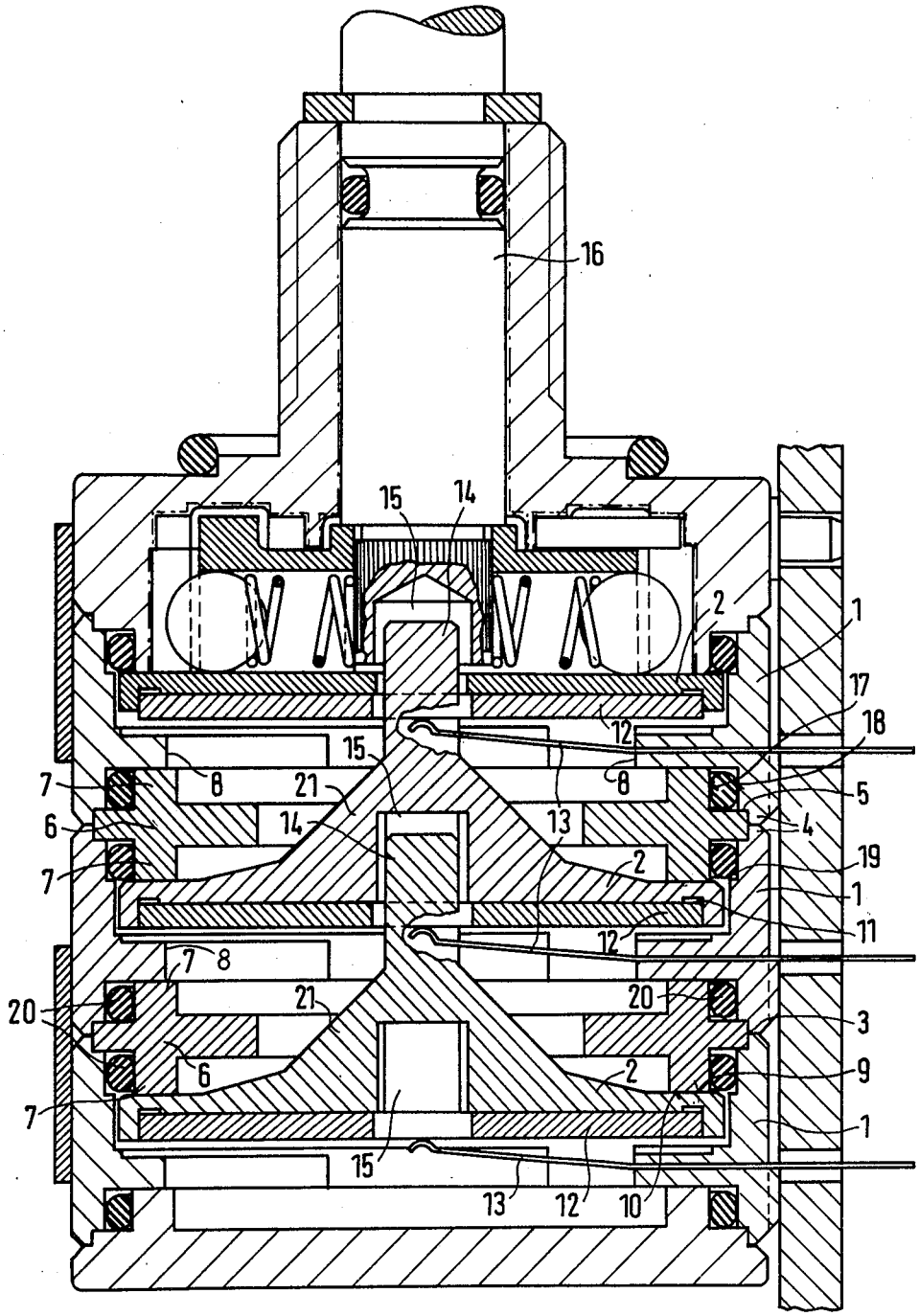
16
15
14
2
1
17
18
12
15
8
21
8
5
7
6
14
13
4
19
7
2
1
11
12
7
8
20
21
20
3
6
2
9
7
1
15
13
12
10

MULTISTAGE ROTARY SWITCH

BACKGROUND OF THE INVENTION

The present invention relates to a multistage rotary switch with several switch wafers, with each switch wafer comprising a case member with laterally inserted fixed contacts and a rotor with the swivel-type contacts, with the stacked case members forming a multistage rotary switch with a closed casing.

From DE-AS No. 2 617 606 there is known a multisection cam switch having a closed casing in which a moulded plate is provided for between the individual case members. This moulded plate is to have moulded portions cooperating with the matching recesses provided for in the case members. How these moulded portions are designed and what purpose the moulded plates serve, cannot be discerned from the cited reference.

In a multistage rotary switch as known from DE-OS No. 2 355 175, each switch wafer consists of a disk having a central bore in which the rotor is arranged in the same plane. On the rim portions of the disk, at two almost diagonally opposite points, there are provided hooks projecting in one direction. Accordingly, this multistage rotary switch has no closed casing. The projecting hooks engage into the disk of the following switch wafer. For serving as an anti-rotation means and for enabling an exact stacking, a pin is moulded on the side opposite the hook, which engages into a corresponding recess of the switch wafer disk arranged on the other side. The rotor is fixed in the axial direction by the contact spring assemblies arranged on both sides of the disk or the rotor.

The present invention is aimed at solving, amongst others, the problem of enabling in the case of a multistage rotary switch of the type mentioned hereinbefore, an exact stacking of the component parts and, at the same time, especially in the case of switches comprising many switch wafers, of keeping the torque which is necessary for operating the switch as small as possible.

SUMMARY OF THE INVENTION

According to the invention, this object is achieved in that the case members, at the inner edges of the rim portions neighbouring one another in the stacked state, are provided with centering grooves of equal dimensions in which a centering ring is inserted, that the fixed contacts press the associated rotor with one sliding surface thereof against a bearing surface of the centering ring, and that the centering ring and, if so required, also the rotor are made from a plastics material having a small coefficient of friction. Accordingly, in this way an exact fixing of the component parts in relation to one another is possible and, moreover, the case members can be made from a plastics material which, for example, can be chosen in accordance with economical and/or mechanical strength requirements and which, if so required, and for stability reasons and/or for the color-coding purpose, may still be mixed with corresponding materials, such as powders or particles or fibers.

Accordingly, the material of the centering ring and, if so required, also of the rotor may be a plastics material which, under certain circumstances, may also be more expensive and to which, if so required, substances such as molybdenum disulfide may be added for increasing the sliding properties. As the material for the centering ring and, if so required, for the rotor it is particularly suitable to use a plastics material which, for example, is known under the trade name "Delrin".

Further advantageous embodiments of the invention are set forth in the following description.

BRIEF DESCRIPTION OF THE DRAWING

In the following, the invention will now be described with reference to an example of embodiment shown in the accompanying drawing. The sole FIGURE drawing shows a multistage rotary switch comprising three switch wafers.

DETAILED DESCRIPTION

Each of the switch wafers includes a case member 1 with a disk-shaped recess for receiving a rotatable, disk-shaped rotor 2 which is axially displaceable therein with a small degree of radial play.

Each case member 1 is provided at the inner edge 3 of the rim portions 4 with an e.g., angular centering groove 5 of equal dimensions, so that on neighbouring edges 4 there will result a continuous groove. Into this groove there is inserted a centering ring 6. This ring is provided with a rim 7 on both sides. The one of these rims is applied to an annular web 8 of the case member 1 of the following switch wafer, and the other one has a bearing surface 9 on which the rotor 2 is permitted to slide with its sliding surface 10.

The rotor 2 has a preferably disk-shaped recess 11 in which a contact plate 12 provided with contacts and one or more conductor leads connecting the contacts, is inserted antirotationally. The contacts of the contact plate 12 are acted upon by contact springs 13 inserted or moulded on the side of the case member 1, by which the rotor 2 can be pressed against the centering ring 6 and, the latter, against the case member 1 of the following switch wafer.

To the point end of the funnel-shaped center portion 21 of the rotor 2 there is moulded a coupling pin 14. This pin has a non-circular, e.g., elliptical or polygonal cross section or its outer surface is provided with an external toothing. The coupling pin 14 projects into a blind hole 15 adapted to the outer contour thereof, of the following rotor 2 stacked thereabove, or the top one projects into such a blind hole 15 as provided for in the switch spindle 16, thus permitting all rotors 2 to be rotated simultaneously via the same switch spindle 16.

According to the invention, the centering ring 6 and, appropriately, also the rotor 2, are made from the aforementioned low-friction material.

Preferably, the rims 7 may be arranged to be set back to such an extent as to leave an interspace 19 between the outer surface 17 thereof and the inner case wall 18, in which a packing ring 20 may be arranged. Appropriately, during the assembly, the centering ring 6 may then serve as a support for the packing rings 20.

The assembly of the individual component parts is carried out in the manner known per se, for example, with the aid of screws or rivets which may be passed through the holes in the case members 1. For example, the case members 1 are square in a top view, and the screws are led through holes provided for in the corners thereof.

What is claimed is:

1. A multistage rotary switch comprising:

plural stacked wafers each including a case member having upper and lower edges, an edge of one such case member being stackable upon an edge of the case member of the next adjacent wafer to form a closed casing, each said case member including grooves on the inner wall of the case member adjacent the upper and lower edges thereof;

a centering ring extending into the grooves adjacent the edges which are stacked to center adjacent stacked case members, said centering ring including a sliding surface thereon;

a rotor in each said case member mounted for rotation therein and bearing against said sliding surface of said centering ring, said rotor where it bears against said sliding surface and said sliding surface being formed of a material having a low coefficient of friction; and urging means urging said rotor toward said sliding surface.

2. The switch of claim 1, wherein said centering ring includes an annular rim spaced from the perimeter of the ring and the inner wall of said case member to define a space between the rim and the inner wall, and a packing ring in said space.

3. The switch of claim 2, wherein said sliding surface is on said rim.

4. The switch of claim 1, wherein said centering ring includes an annular rim thereon, and said sliding surface is on said rim.

5. The switch of claim 4, wherein said centering ring includes a second annular rim on the side of said centering ring opposite the first mentioned annular rim, said second annular rim bearing against the case member of the next adjacent wafer.

6. The switch of claim 1, wherein said rotor includes a funnel shaped portion on one side thereof having a point end, a coupling pin on said point end for rotating said rotor, and a blind hole on the other side thereof for receiving the coupling pin of the next adjacent rotor.

7. The switch of claim 6, including a spindle for rotating the rotors, said spindle including a blind hole for receiving said coupling pin of one of the rotors.

8. The switch of claim 1, wherein one side of said rotor bears against said sliding surface, and a contact plate having contacts thereon is positioned on the other side of said rotor.

9. The switch of claim 8, wherein said other side of said rotor includes a recess and said contact plate is positioned in said recess.

10. The switch of claim 8, wherein said urging means comprises a fixed contact which bears against said contact plate.

11. The switch of claim 1, wherein said urging means comprises a fixed contact which bears against said rotor.

* * * * *